United States Patent [19]

Saito et al.

[11] 4,061,558

[45] Dec. 6, 1977

[54] ELECTRODE

[75] Inventors: Shunjiro Saito; Kazuhide Aue; Nobuei Shimojo, all of Tokyo, Japan

[73] Assignee: TDK Electronics Co., Ltd., Tokyo, Japan

[21] Appl. No.: 694,467

[22] Filed: June 9, 1976

[30] Foreign Application Priority Data

June 9, 1975 Japan ..... 50-69392

[51] Int. Cl.[2] ..... C25B 11/08; C25B 11/10

[52] U.S. Cl. ..... 204/290 F; 204/290 R

[58] Field of Search ..... 204/290 R, 290 F

[56] References Cited

U.S. PATENT DOCUMENTS

| | | | |
|---|---|---|---|
| 3,793,164 | 2/1974 | Kolb et al. | 204/99 |
| 3,865,703 | 2/1975 | Schenker et al. | 204/105 R |
| 3,875,043 | 4/1975 | Franks et al. | 204/290 F |

*Primary Examiner*—F.C. Edmundson

*Attorney, Agent, or Firm*—Oblon, Fisher, Spivak, McClelland & Maier

[57] ABSTRACT

An electrode comprises a conductive substrate which is coated with 7 to 50 mole % of a total combination of palladium oxide and ruthenium oxide and 93 to 50 mole % of tin oxide as the main components, wherein less than 40 mole % of said tin oxide is substituted with titanium oxide.

7 Claims, No Drawings

ELECTRODE

BACKGROUND OF THE INVENTION

1. Field of the Invention

The present invention relates to an anode for electrolysis which possesses high oxygen overvoltage characteristics and excellent anticorrosive properties.

2. Description of the Prior Art

Heretofore, alkali metal halide electrolysis such as the electolysis of sodium chloride has been chiefly conducted by the mercury process. However, the drainage from the mercury process is a source of pollution. Workable alternatives to the mercury process are the diaphragm process or the ion-exchange membrane process. In the diaphragm process, the current density is less than that of the mercury process during the operation. However, the electrodes employed in the process have a low oxygen over-voltage. Thus, when these electrodes are used in the diaphragm process or the ion-exchange membrance process, about 1 to 5% oxygen is included in the chlorine produced. Because of the presence of oxygen, the anolytic gas cannot be directly fed to a petrochemical plant. In order to use the anolytic gas it is necessary to remove oxygen. The oxygen removal process is complicated, which increases the cost of the gas.

The platinum group elements are believed to be catalysts for the electrode. In the electrolysis of an aqueous solution of an alkali metal salt, the chlorine overvoltage, oxygen overvoltage and anticorrosive properties are of the following order.

Chlorine overvoltage:

$$Pd \approx Ru < Ir << Rh <<< Pt$$

Oxygen overvoltage:

$$Ru < Ir < Rh < Pd < Pt$$

Anticorrosive property:

$$Ru < Pd < Pt < Ir < Rh$$

In general, when a platinum group element is used, there is no catalyst for the electrode which has balanced low chlorine overvoltage, high oxygen overvoltage and high anticorrosive properties. If one property is satisfactory, then another property is not satisfactory. In order to improve the conventional electrodes, various combinations of Pd, Ru or Ir which have low chlorine overvoltage and Pt, Ir or Rh which have substantial anticorrosive properties have been studied. However, these combinations have not possessed either satisfactory anticorrosive properties or satisfactory oxygen overvoltage.

Among the platinum group metals, palladium seems to be optimum from the viewpoint of the slow rate of generation of oxygen and the level of catalytic activity of the electrode for the chlorine electrode reaction. However, when metallic palladium is coated on the electrode, it possesses poor anticorrosive characteristics, and consequently, it dissolves during electrolysis. Thus, this type of electrode is not practically useful. If the electrode is coated with palladium oxide (PbO), the adhesiveness of the membrane is inferior because of differences between the crystalline form of palladium oxide and the crystalline form of titanium oxide which result upon oxidation of the substrate.

In the present invention various combinations of platinum oxide and tin oxide have been studied. As a result, the electrolysis electrode which is prepared by coating a membrane of iridium oxide and tin oxide or a membrane or ruthenium oxide and tin oxide on a conductive substrate could not be practically used because when an oxygen overvoltage greater than 0.6 Volt is obtained at the current density of 20 mA/cm$^2$ to decrease the generation of oxygen gas, the chlorine overvoltage is higher than 0.1 Volt. While the combination of platinum oxide and tin oxide exhibits excellent initial characteristics it could not be practically used because of substantial variations in ageing characteristics. However, it has now been found that the combination of 5 to 40 mole % of palladium oxide and 95 to 60 mole % of tin oxide achieves a satisfactory oxygen overvoltage, chlorine overvoltage and anticorrosive property. Thus, further improvement in an electrode having balanced characteristics has been attained.

SUMMARY OF THE INVENTION

One object of the present invention is to provide an electrode for alkali metal halide electrolysis which has balanced and satisfactory low chlorine overvoltage, high oxygen overvoltage and high anticorrosive characteristics.

This object and other objects of the present invention have been attained by an electrode which comprises a conductive substrate coated with a total of 7 to 50 mole % of palladium oxide and ruthenium oxide and 93 to 50 mole % of tin oxide as the principal components. Less than 40 mole % of the tin oxide can be substituted with titanium oxide. In a preferred embodiment a conductive substrate is coated with a membrane comprising 5 to 40 mole % of palladium oxide, 2 to 10 % of ruthenium oxide and 93 to 50 mole % of tin oxide or mixtures of tin oxide and titanium oxide as the main components.

DETAILED DESCRIPTION OF THE PREFERRED EMBODIMENTS

In the present invention, a conductive substrate is coated with the oxides of palladium, ruthenium and tin wherein a portion of the tin can be substituted with titanium, as the main components of a tetragonal system whereby the chlorine overvoltage is maintained at a lower level, the anticorrosive property is improved and the oxygen overvoltage is maintained at a value higher than 0.6 Volt. When the composition of the membrane for the electrode consists of a mixture of oxides of ruthenium, palladium and tin (or tin and titanium), it was predicted that the overvoltages should be controlled by ruthenium oxide which exhibits the lowest overvoltages (chlorine overvoltage of about 0.01 volt and an oxygen overvoltage of about 0.4 volt) in the electrolysis to thereby impart low oxygen overvoltage to the electrode. However, in accordance with the present invention, the oxygen overvoltage is sufficiently high. This high oxygen overvoltage may result from a certain synergistic effect from the mixed oxides of palladium, ruthenium and tin.

The process for preparing the electrodes of the invention will now be illustrated. Suitable compounds include the chlorides, nitrates, acetates, sulfates and organic compounds of ruthenium, palladium, tin and titanium. Preferably, ruthenium chloride, palladium chloride and tin chloride with or without an organic titanium compound are dissolved in an organic solvent. The resulting solution is coated on a conductive substrate such as Ti, Ta, Zr or the like. The oxygen partial pressure over the coated substrate is controlled in the range of 0.002 to 0.5 atm, and the coated substrate is heated at 400° to 800° C for 5 to 100 minutes to achieve thermal decomposition. The same process is repeated several times to form the desired membrane.

The electrode of the invention can be prepared by plating the desired metals on the conductive substrate, and heating it under the above indicated oxygen partial pressure, or by sputtering, baking molten injection or anodic oxidation under said oxygen partial pressure.

In the three element system of palladium, ruthenium and tin, when the ratio of palladium is increased, the chlorine overvoltage and the oxygen overvoltage are increased. On the other hand, when the amount of ruthenium is increased, the chlorine overvoltage and the oxygen overvoltage are decreased. When the amount of tin is increased to a range within a low amount range of ruthenium, the chlorine overvoltage and the oxygen overvoltage are increased. In the three element system, the compositions which achieve a chlorine overvoltage of less than 0.1 volt, and an oxygen overvoltage of less than 0.6 volt comprise 5 to 40 mole % of the palladium component, 2 to 10 mole % of the ruthenium component and 93 to 50 mole % of tin. It has been confirmed that the compositions possess satisfactory anticorrosive properties. In the three element system, if less than 40 mole % of the tin component, based on a total tin component content of 93 to 50 mole %, is substituted with a titanium component, the adhesive properties of the conductive substrate and the membrane of the oxides can be improved. However, if more than 40 mole % of tin component is substituted by titanium, palladium metal is formed which detrimentally affects the anticorrosive properties and increases the chlorine overvoltage. Accordingly, the amount of titanium component substituted for tin should be less than 40 mole %.

The invention will be further illustrated by certain examples.

EXAMPLE 1

$PdCl_2$: 0.075g
$RuCl_2\,nH_2O$ ($n \approx 3$): 0.044g
$SnCl_4\,5H_2O$: 2.771g
n-butyl alcohol: 20 ml
HCl: 1 ml The above components were mixed to form a coating solution. A titanium plate was washed with a hot aqueous solution of oxalic acid. The solution was coated on a titanium plate, and the coated plate was dried and heated in a furnace tube in air at 500° C for 10 minutes to affect thermal decomposition. The operation was repeated 4 times to form a sample of a titanium plate coated with a membrane of 5 mole % palladium oxide, 3 mole % ruthenium oxide and 92 mole % tin oxide. The polarization of the sample was measured by the potential scanning method at a scanning speed of 240 sec./volt. In the measurement, a lead wire was soldered on a bare surface of a sample (5 × 20 × 1 mm) on which the membrane was not coated, and the bare surface was sealed with an insulation paint. Chlorine overvoltage and oxygen overvoltage were measured at 30° C in an aqueous solution of 30 wt.% NaCl (pH= 1) and in a 1M aqueous solution of $H_2SO_4$ at a current density of 20 mA/cm². As a result, the chlorine overvoltage was 0.02 volt and the oxygen overvoltage was 0.75 volt.

EXAMPLE 2

The process of Example 1 was repeated except that the amounts of palladium chloride, ruthenium chloride and stannic oxide were varied. The samples were prepared by heating the coated substrates at 500° C for 10 minutes in air (press$O_2$= 0.2 atm.). The results are shown in Table 1.

TABLE 1

| | Composition (mole %) | | | Overvoltage (V) | |
|---|---|---|---|---|---|
| No. | Pd | Ru | Sn | $\eta Cl_2$ | $\eta O_2$ |
| 1 | 2 | 5 | 93 | 0.03 | 0.72 |
| 2 | 5 | 2 | 93 | 0.02 | 0.75 |
| 3 | 2 | 8 | 90 | 0.04 | 0.70 |
| 4 | 8 | 2 | 90 | 0.02 | 0.70 |
| 5 | 10 | 10 | 80 | 0.02 | 0.68 |
| 6 | 10 | 15 | 75 | 0.01 | 0.62 |
| 7 | 15 | 10 | 75 | 0.01 | 0.63 |
| 8 | 20 | 10 | 70 | 0.02 | 0.68 |
| 9 | 30 | 10 | 60 | 0.01 | 0.61 |
| 10 | 40 | 10 | 50 | 0.02 | 0.65 |

EXAMPLE 3

The process of Example 1 was repeated except that the amounts of palladium chloride, ruthenium chloride and stannous chloride were varied. Less than 40 mole % of the tin component was substituted with butyl titanate, and the samples were prepared by heating at 500° C for 10 minutes in air (press $O_2$=0.2 atm.). The results are shown in Table 2.

TABLE 2

| | Composition (mole %) | | | | Overvoltage (V) | |
|---|---|---|---|---|---|---|
| No. | Pd | Ru | Sn | Ti | $\eta Cl_2$ | $\eta O_2$ |
| 11 | 2 | 8 | 80 | 10 | 0.05 | 0.80 |
| 12 | 8 | 2 | 80 | 10 | 0.03 | 0.75 |
| 13 | 10 | 10 | 70 | 10 | 0.01 | 0.71 |
| 14 | 20 | 10 | 60 | 10 | 0.02 | 0.69 |
| 15 | 30 | 10 | 50 | 10 | 0.01 | 0.62 |
| 16 | 8 | 2 | 70 | 20 | 0.06 | 0.80 |
| 17 | 2 | 8 | 60 | 30 | 0.05 | 0.73 |
| 18 | 8 | 2 | 60 | 30 | 0.06 | 0.85 |
| 19 | 10 | 10 | 50 | 30 | 0.02 | 0.70 |
| 20 | 8 | 2 | 50 | 40 | 0.08 | 0.93 |

As shown above, the electrodes of the invention have excellent anticorrosive properties, low chloride overvoltage and high oxygen overvoltage which is a very advantageous combination of properties.

We claim:

1. An electrode which comprises a conductive substrate coated with a composition consisting essentially of from 5–40 mole percent palladium oxide 2–10 mole percent ruthenium oxide, and 93–50 mole percent of tin oxide and titanium oxide, wherein the titanium oxide is less than 40 percent of the tin oxide.

2. The electrode of claim 1, which is used as an anode for generating chlorine under high oxygen overvoltage.

3. The electrode of claim 1, wherein the conductive substrate is titanium, tantalum, or zirconium.

4. The electrode of claim 1, wherein said coating is formed by the thermal decomposition of a chloride, nitrate, acetate, or sulfate compound or an organic compound of the metal components in the presence of oxygen.

5. The electrode of claim 1, wherein said coating is formed by sputtering, in the presence of oxygen or anodic oxidation.

6. The electrode of claim 1, wherein said coating is formed by baking in the presence of oxygen or anodic oxidation.

7. The electrode of claim 1, wherein said coating is formed by melt injection in the presence of oxygen or anodic oxidation.

* * * * *